United States Patent [19]

Blotenberg

[11] Patent Number: 4,789,298

[45] Date of Patent: Dec. 6, 1988

[54] METHOD AND APPARATUS FOR CONTROLLING THE OPERATION OF A TURBOCOMPRESSOR

[75] Inventor: Wilfried Blotenberg, Dinslaken, Fed. Rep. of Germany

[73] Assignee: Man Gutehoffnungshutte GmbH, Fed. Rep. of Germany

[21] Appl. No.: 929,405

[22] Filed: Nov. 10, 1986

[30] Foreign Application Priority Data

Nov. 13, 1985 [DE] Fed. Rep. of Germany ..... 3540285

[51] Int. Cl.[4] ..... F04D 27/02

[52] U.S. Cl. ..... 415/27; 415/1

[58] Field of Search ..... 415/1, 17, 27, 28

[56] References Cited

U.S. PATENT DOCUMENTS

| | | | |
|---|---|---|---|
| 4,139,328 | 2/1979 | Kuper et al. | 415/27 |
| 4,560,319 | 12/1985 | Blotenberg | 415/27 |
| 4,562,531 | 12/1985 | Enterline et al. | 415/27 |
| 4,586,870 | 5/1986 | Hohlweg et al. | 415/27 |
| 4,627,788 | 12/1986 | Keyes, IV et al. | 415/27 |
| 4,640,665 | 2/1987 | Staroselsky et al. | 415/27 |

FOREIGN PATENT DOCUMENTS

| | | | |
|---|---|---|---|
| 157307 | 12/1979 | Japan | 415/27 |
| 2036177 | 6/1980 | United Kingdom | 415/27 |

*Primary Examiner*—Abraham Hershkovitz
*Assistant Examiner*—John T. Kwon
*Attorney, Agent, or Firm*—McGlew and Tuttle

[57] ABSTRACT

The method and apparatus for controlling the operation of a turbocompressor which has a suction and a discharge with a blow-off valve for regulating the performance thereof includes a sensor in the suction and discharge for sensing an operating condition such as pressure and temperature which is connected to deliver to a comparator a performance signal for the control of the blow-off valve. The control signal which is delivered to the comparator is modified in accordance with a memory which includes a blow-off curve gradient which effects the amplification of the signal which is sent to a controller in accordance with the blow-off conditions which are to be set in motion on the basis of the performance characteristics which have been sensed.

8 Claims, 1 Drawing Sheet

METHOD AND APPARATUS FOR CONTROLLING THE OPERATION OF A TURBOCOMPRESSOR

FIELD AND BACKGROUND OF THE INVENTION

This invention relates in general to turbocompressors and in particular to a new and useful method and apparatus for controlling the operation of the turbocompressor using a system having a blow-off control operating curve.

The flowback of pumped medium in surges from the compression side to the suction side is called pumping in compressors. This condition sets in when the end pressure or the ratio of end pressure to suction pressure is too high and/or the throughput is too low. In the characteristic field the throughput or pressure, therefore, can be evaluated to form a pumping limit line or graphic curve separating the characteristic field into a stable and instable zone. The pumping limit line is curved, i.e. it is flatter when the pressure rises.

To protect compressors against pumping, a blow-off line at a safety distance parallel to the pumping limit line is defined, and if the momentary working point approaches the blow-off line a blow-off valve is opened so that the actual value of a control variable, in particular the throughput, does not exceed a set-point value determined by way of the blow-off line and the command vaiable, in particular the end pressure. There are also controls in which the throughput is the command variable to form the set-point value while the end pressure is the variable to be controlled to the set-point value.

Due to the curving of the blow-off line, a fixed change of the command variable will give different charges of the set point, depending on the location along the blow-off line. This has the effect of producing different amplifications on the control circuit.

Pumping limit controls are safety controls and are usually activiated so that they work close to the stability limit to assure the best possible compressor protection. The location of the stability limit is influenced very much by the overall amplification of the control circuit. A high overall amplification is most likely to lead to instability. The amplification factor of the actual controller, therefore, is adjusted so that it, together with the amplification resulting from the gradient of the blow-off line, leads to an overall amplification still within the stability limit. Of course, the adjustment should affect the blow-off line section in which the highest amplification is effective. In other blow-off line sections, to which may also belong the most frequent working ranges, the control circuit is then not optimally adjusted. Therefore, it is a consequence of the severely curved blow-off line that a pumping limit controller with fixed control parameters is not optimally adjusted in wide working ranges.

SUMMARY OF THE INVENTION

The invention provides a method and a device by means of an adaptation of the control behavior of a compressor system to the requirements for its operation is possible in the various characteristic field zone.

In accordance with a method of the invention, the operation of a turbocompressor which has a suction and a discharge with a blow-off valve is effected by using a calculator which is connected to a memory having a performance operating curve providing blow-off performance characteristics which controls the operation of a calculator which is connected to the sensors in a suction and discharge for sensing performance activities. The calculator is associated with a memory which makes amplification of the control parameters of the blow-off control loop in accordance with the desirable performance considerations in the memory and as varied by the information supplied by the sensors in the suction and discharge.

The invention provides a device and method to compensate the effects of the curved blow-off line gradient changing in accordance with the command variable, upon the overall amplification of the control circuit by a corresponding change in the opposite sense of the controller's amplification factor, resulting in a largely constant overall amplification of the control circuit in the entire working range. This basic principle, however, can also be approximated by switching between two or a few different values of the controller amplification factor.

An object of the invention is to provide an improved method and apparatus for controlling the operation of a turbocompressor.

A further object of the invention is to provide a turbocompressor construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
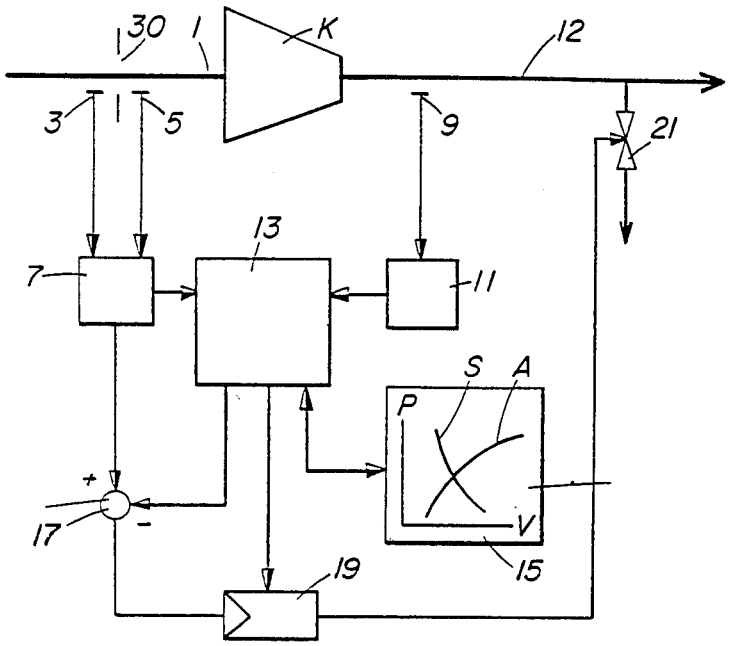
FIG. 1 is a schematic view of a turbocompressor control device to prevent pumping constructed in accordance with the invention.

Referring to the drawings in particular, the invention embodied therein comprises a method and device for controlling the operation of a turbocompressor K which has a suction 1 and a discharge 12 which has a blow-off valve 21. In accordance with the invention, sensors 3 and 5 are arranged in spaced locations in the suction 1 and at least one location 9 in the discharge 12 and they are connected through transducers 7 and 11 respectively to a calculator or comparator—or original processor—13. Calculator 13 is connected to a memory 15 having performance characteristics values which compare signals which are transmitted by the transducers 7 and 11 to the calculator to affect operation of a control 19 to operate the blow-off valve 21 in accordance with the proper fulfillment characteristics which should be in effect by the sensed conditions. In the embodiment of FIG. 1 an adder 17 is connected between the transducer 7 and the calculator 13.

According to FIG. 1, sensors 3, 5 are arranged in the suction nipple or connection 1 of a compressor K and sense the pressure, ahead of, and behind a throttling aperture 30, wherefrom a transducer 7 forms the actual value for the compressor throughput V on the suction side. A sensor 9 at the compressor outlet acquires the actual value of the end pressure which is put into calculator 13 via a transducer 11. Connected to the calculator 13 is a memory 15 in which the blow-off curve A in the compressor characteristic field defined by P (pressure) and V (volume) is stored. For the actual P value the calculator 13 determines the set-point value for the throughput V. Actual and set-point values are compared in an adder 17, and the difference is fed as input signal to a controller 19 which may have a proportional, integral and/or differential behavior and whose output signal furnishes a control variable for a blow-off value 21 branched off the compressor outlet or for a recycle valve leading back to the suction nipple 1.

Figure 2:
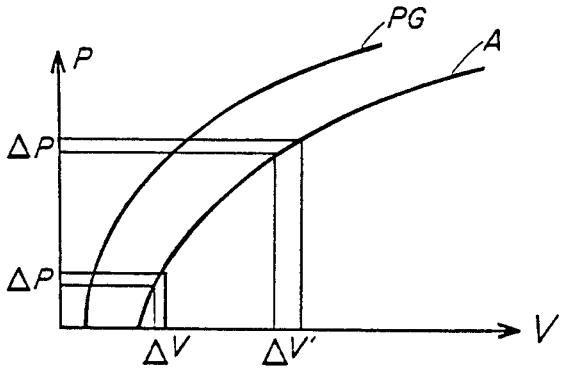
FIG. 2 is a graph having a pumping limit curve and the blow-off line depicted for the characteristic field of the compressor.

As shown in FIG. 2, both the pumping limit line PG and the blow-off line A spaced at a safety distance to the right of the former are curved in the compressor characteristic field defined by the throughput V as abscissa and the end pressure P (or also the end pressure to suction pressure ratio) as ordinate. The consequence thereof is that a certain change $\Delta P$ of the end pressure serving as command variable corresponds to different throughput set-point values $\Delta V$ and $\Delta V'$, respectively. Since the calculator 13, serving as set-point generator, forms part of the control circuit, these differences have the effect of changes in the overall amplification of the control circuit, if the controller 19 has a constant amplification factor (gain). In FIG. 2, the steep lower part of the blow-off curve A corresponds to small amplification and the flat upper part of high amplification. However, if the role of the command and control variables is exchanged, which is also known, and the throughput V is used as command variable to determine a set-point value for the end pressure P, then the conditions are reversed and amplification is great in the steep portion of the blow-off curve and small in the flat portion.

The overall amplification of the control circuit is the sum of amplification resulting from the gradient of the blow-off curve and of the amplification factor of the controller 19 plus the so-called system amplification, i.e. the amplification factors given by the control system, in particular the compressor and the blow-off valve. To achieve an amplification as constant as possible in all areas, therefore the amplification factor in the controller 19 is altered, according to the invention. In the embodiment according to FIG. 1, there is preset as a function in the memory 15, in addition to the blow-off curve A, a curve sharing the course of curve A and representing the gradient of the blow-off curve A. The computer 13 computes for each actual value of the command variable P the associated value of the blow-off curve gradient and generates a corresponding control signal which is fed to a control input of the controller 19, causing there a corresponding alteration of the amplification factor of the controller 19.

Instead of recalling from the memory 15 in the respective gradient value of the blow-off curve A, the calculator 13 can also compute from the blow-off curve A values belonging to the various P values of the gradient of the blow-off curve A.

Figure 3:
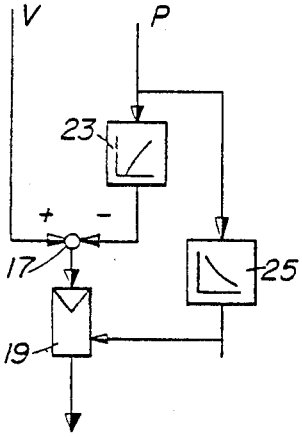
FIG. 3 is a part of a simplified embodiment of the control device shown in FIG. 1.

In the simplified embodiment according to FIG. 3, the actual P value is not fed to a calculator, but to a simple function generator 23 which coordinates with each actual P value a set-point value for V in accordance with a given relationship corresponding to the blow-off curve A. In addition, the actual P value is fed to a second function generator 25 which coordinates with each actual P value a corresponding value for the flow-off curve gradient, which value is then fed to the conroller 19 as control signal for the control of the amplification factor.

Figure 4:
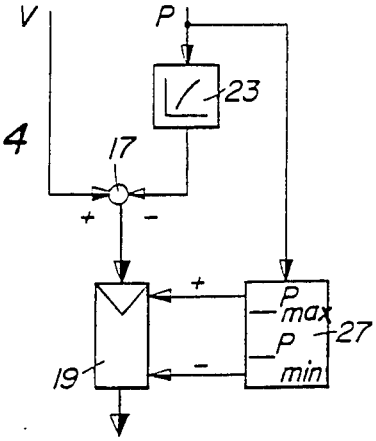
FIG. 4 is a view similar to FIG. 3 of another emobdiment of the control device.

In the embodiment according to FIG. 4, the actual P value is also fed to the function generator 23 and additionally to a comparator 27 which compares the actual P value with specified upper and lower limits $P_{max}$, $P_{min}$. As long as the actual P value stays within these limits, the amplification factor of the controller 19 remains unchanged. But if $P_{max}$ or $P_{min}$ is exceeded, the amplification factor of the controller 19 is increased or decreased by a specified amount. This corresponds to an approximation of the curving of the blow-off line through three straight sections of different gradients, the straight section in the middle being between the limits $P_{min}$, $P_{max}$. In a still simpler embodiment, corresponding to an approximation of the blow-off curve through only two straight sections, the amplification factor is controlled between two values after either $P_{max}$ or $P_{min}$ was exceeded.

It is possible also in the embodiment according to FIG. 1 to approximate the curvature of the blow-off line or its gradient through straight sections, whereby the memory 15 has to store only the coordinate of the salient points of the straight sections from which the calculator 13 can then compute the course of the straight section or its gradient. Also, the blow-off curve can be stored in the memory 15 not in the form of a table of values, but in the form of a mathematical function. Correspondingly, in the embodiment according to FIG. 3, a blow-off curve approximated by two or more straight sections can be preset in the function generator 25.

It goes without saying that the operating mode described is not restricted to the selected representation of the characteristic field with the coordinate end pressure and throughput, but can analogously also be adapted to any other representation of the characteristic field with which the specialist is familiar.

While specific embodiments of the invention have been shown and described in detail to illustrate the application of the principles of the invention, it will be understood that the invention may be embodied otherwise without departing from such principles.

What is claimed is:

1. A method of controlling the operation of a turbocompressor having an intake line and an outlet line with a blow off valve so as to prevent compressor surge, comprising the steps of: sensing the volumetric flow of the intake line upstream of the turbocompressor and forming a signal representative of the volumetric flow sensed; sensing the discharge pressure of the turbocompressor at the outlet and forming a signal representative of the discharge pressure sensed; storing a blow-off curve, defined by the predetermined relationship between the volumetric flow and the discharge pressure, into a memory and also storing a gradient curve representing the gradient of the stored blow-off curve into a memory; comparing said sensed volumetric flow and said sensed discharge pressure with said blow off curve to generate a control signal using a proportional integral controller or a proportional integral differential controller; and, comparing one of said sensed volumetric flow and sensed discharge pressure with a corresponding value for the blow-off curve gradient of said gradient curve to produce an amplification factor and varying the amplification of the controller in accordance with the amplification factor.

2. A method according to claim 1, wherein the amplification is controlled at least approximately inversely proportional to the blow-curve gradient value.

3. A method according to claim 1, wherein the blow-off curve is approximated through straight sections and the controller's amplification factor is controlled between different discrete values if the actual value of the command variables exceeds specified limits.

4. A device for controlling the operation of a turbocompressor having a suction line and a discharge line with a blow-off valve, comprising: first sensor means associated with said upstream line for sensing volumetric flow in said upstream line and forming a signal representative of said upstream flow; second sensor means associated with said discharge line for sensing pressure in said discharge line and formulating a signal representative of said discharge pressure; memory means for storing a blow-off curve defined by the pressure and volumetric flow characteristics of the turbocompressor and for storing a gradient curve representative of the gradient of said blow-off curve; comparator means connected to said first sensor means and said second sensor means for receiving said volumetric flow signal and said discharge pressure signal and connected to said memory means for accessing said stored blow-off curve, said comparator means determining the difference between a working point, defined by the discharge pressure signal and the volumetric flow signal, and the blow-off curve and for generating a set point signal representing the difference; control means including one of a proportional-integral and proportional-integral-differential control for receiving said set point signal and producing a control signal for operating a blow-off valve; and, amplification factor means for receiving at least one of said volumetric flow signal and said discharge pressure signal and for accessing said gradient curve to produce an amplification factor signal in accordance with the gradient of the blow-off curve of at least one of said volumetric flow signal and said discharge pressure signal, said amplification factor signal being directed to said control means for compensating said control signal.

5. A device according to claim 4, wherein said control means has an input to alter its amplification factor, said amplification factor means including a signal processor with specified data coordinating with the gradient of the blow-off curve and having an output which is connected to an input of said control means for operating the blow-off valve.

6. A device according to claim 5, wherein said memory includes a sequence of values representing the blow-off curve gradient as a function of said at least one of said volumetric flow signal and said discharge pressure signal.

7. A device according to claim 6, wherein said memory means includes limits of the pressure between a maximum and a minimum for said at least one of said volumetric flow signal and said discharge pressure signal which, are preset, said signal processor generating switching signals for stepwise alteration of a control factor connected to said control means for operating said control means when the limits are exceeded.

8. A device according to claim 4, wherein said control means receives an amplification factor which is controllable by selectively tuning an amplifier preceding an input of the control means said signal processor output signal controlling the tuning of the amplifier.

* * * * *